United States Patent [19]

Smida

[11] 3,962,769

[45] June 15, 1976

[54] HYDRAULIC CHUCK

[76] Inventor: George R. Smida, 2039 105th Ave. Northeast, Minneapolis, Minn. 55434

[22] Filed: Apr. 2, 1975

[21] Appl. No.: 564,415

[52] U.S. Cl. ..... 29/202 D; 279/4
[51] Int. Cl.[2] ..... B23P 15/26
[58] Field of Search ..... 29/202 D; 279/4

[56] References Cited

UNITED STATES PATENTS

| | | | |
|---|---|---|---|
| 2,724,563 | 3/1971 | Wickham et al. | 279/4 |
| 3,813,751 | 6/1974 | Smida | 29/202 |

*Primary Examiner*—Lowell A. Larson

[57] ABSTRACT

A hydraulic chuck having a piston means with an axially centered passage and a first end sized to engage a tube. Collet means are located at the first end of the piston for engagement with said tube upon closure of the collet means. Surface means bearing on the collet means are provided to close the collet on the tube. Biasing means are provided to normally force the surface means against the collet means to incur a normally closed position of the collet. A handle or attachment means is provided for movement of the biasing means to remove the surface means from the collet means whereby the tube may be inserted into the chuck. Finally, passage defining means in the piston means are provided to force the surface means onto the collet means when fluid is passed through the axially centered passage.

5 Claims, 1 Drawing Figure

HYDRAULIC CHUCK

BACKGROUND OF THE INVENTION

Fluid pressure operated devices for radially expanding portions of tubing are known, such devices being disclosed in U.S. Pat. Nos. 1,448,457; 2,479,702; 2,938,562 and 3,200,627. The structures of these patents include fluid conveying mandrels receivable within the tubes, means for expanding the mandrels to hold the tubing, and die elements against which portions of the tubing are flared or otherwise formed by fluid pressure. These expanding devices are customarily used to provide short bulges in tubing for coupling purposes and the like. In addition, they are used to expand tubing to fit fins and other apparatus connected to the outer surface of the tubing.

Several hydraulic chucks have been developed which are suitable for tightly gripping one end of the elongated tube while simultaneously delivering a tube expanding fluid. Among these are U.S. Pat. Nos. 3,505,846 and 3,813,751.

SUMMARY OF THE INVENTION

The invention relates broadly to chucks and more specifically to a hydraulic chuck for tightly gripping one end of an elongated tube and simultaneously delivering fluid to the tube to expand the same. It is an object of this invention to provide a tube engaging chuck which is capable of pregripping the tube for easy connection. Another object of this invention is to provide a chuck which permits preloading of the tube to be expanded. This is of particular advantage in complicated assemblies wherein a large tube or a multiplicity of tubes are being expanded in an apparatus wherein the relationship spatially of one to another is critical. By being able to preload the tubes with fluid, it is possible to rearrange and restructure the relative relationships of the tubes immediately prior to expansion without any surge occuring from the addition of fluid to the tubes themselves.

DESCRIPTION OF THE DRAWINGS

The FIGURE is a sectioned view in side elevation of the hydraulic chuck of this invention, with the section taken along the center axis of the chuck.

DETAILED DESCRIPTION OF THE INVENTION

Figure 2:
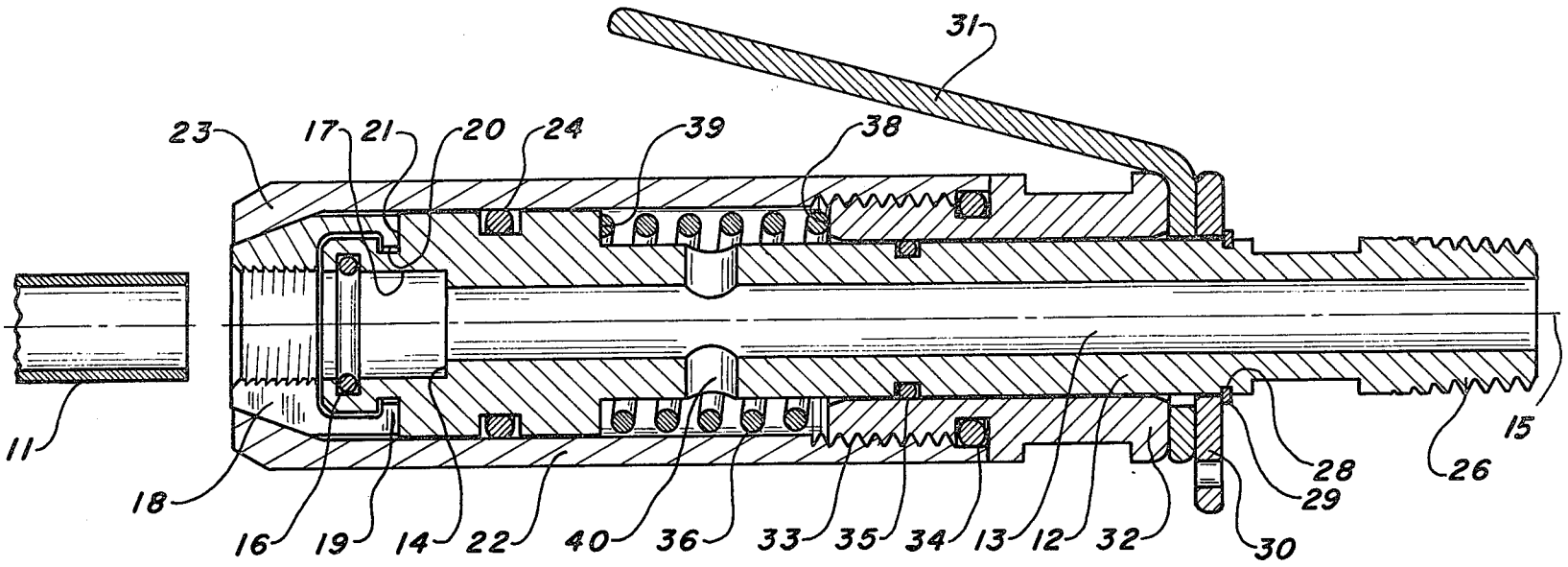

As shown in the FIGURE, the chuck generally is shown by reference numeral 10. Contained as a part of the chuck of this invention is a piston 12 which contains a central passage 13 located about axis 15. The tube 11 is inserted into the chuck into tube holding recess 17 past O-ring 16 and fitted up against the tube stop 14. The function of the tube stop 14 is to prevent the tube 11 from entering into the chuck beyond that point while permitting passage of fluid from a source (not shown) through central passage 13 into the tube for use as desired.

Collets 18 are provided to grasp the tube 11. These collets are conventional in design, having three cross-sectionally arcuate tube gripping jaws positioned in circumferentially spaced relationship about the tube 11. The gripping jaws may be smooth, or may have gripping surfaces to achieve greater purchase on the tube. A portion of the collet 18 extends into the recess 20 of the piston 12 so that the lip 19 of the collets 18 is restrained in the recess 20 to maintain the collets in their generally circumferential relationship about the tube opening 17.

Movement of the piston 12 in the direction of the tube 11 will cause the piston head 21 to force on the collets 18 to cause closure thereof.

Surrounding the piston 12 and the collets 18 is a body 22 which contains a tapered end 23. Tapered end 23 bears against the collets 18 and forces them into contact with the tube when the piston 12 forces the piston head 21 against the collets to effect closure thereof.

At the other end of the piston 12 is a conventional fitting 26 which is suitable for connection to a conventional quick disconnect coupler (not shown) which is connected to a supply of fluid for use of the device.

Also at the other end of the piston 12 is a recess 28 which contains a snap ring 29 holding in place a rear plate 30. The rear plate 30 prevents movement of any of the parts past that point in the direction away from tube 11. A handle 31 is provided in contacting relationship with the end or rear plate 30. Adjacent the handle 31 and upstream thereof towards the tube 11 is a rear head 32 which is threaded onto the body 22. O-ring seals 34 and 35 are provided to prevent leakage of fluid.

A biasing means or spring 36 is positioned in the interior of the body 22 and bears against the rear head 32 at surface 38. The spring 36 also bears against the piston 12 at surface 39. In the normal operation of the device, this spring 36 is under compression, thereby forcing the piston 12 toward the tube. Thus, in the normal condition of the chuck, the spring 36 forces the piston 12 to bear against the collets 18 through piston head 21. The tapered end 23 of the body 22 forces the collets 18 into a closed position. O-ring 24 prevents leakage of fluid in that direction.

Depression of the handle 31 causes the handle to bear against the rear plate 30 which is restrained by the snap ring 29 in recess 28. As the handle 31 is depressed the spring 36 is further compressed by the movement of the rear head 32 coupled to the body 22 relative to the position of the piston 12. This relative movement of the piston 12 with the outer portions of the chuck 32 and 22 causes a withdrawal of the contact of the tapered end 23 on the collets 18, thereby permitting release of the collets from their normally closed position. Therefore, when the handle is depressed, the collets fall away from the recess 17 and permit insertion of the tube 11 past the O-ring seal 16 into the chuck up onto the position defined by the tube stop 14. Release of the handle actuates the spring 36 to cause the relative movement back to the normal operating position, whereby the collets 18 firmly grip the tube 11.

A port 40 is provided in communication with the central passage 13 and in further communication with the gap between the piston 12 and the body 22 which house the spring 36. When fluid passes through the central passage 13, it passes through port 40 and fills the chamber containing the spring 36. When the fluid is under pressure, the fluid pressure acts as a force against the surface 39 to increase the pressure of piston head 21 on collets 18 against tapered end 23. If the pressure increases, the force of the collets holding the tube increases.

Thus it can be seen that the chuck of this invention may be inserted onto a tube by depression of the handle and placement of the tube into the cavity provided therefore. The collets serve to grip the tube and prevent movement under normal conditions. Upon passage of the fluid through the central passage 13, the tube 11 may be prefilled prior to the use of high pressure for expansion of the tube or whatever.

Having thus described the invention, what is claimed is:

1. A hydraulic chuck, comprising:

piston means having an axially centered passage, the first end of said piston means being sized to engage a tube;

collet means located at said first end of said piston means for engagement of said tube upon closure of said collet means;

surface means bearing upon said collet means to close said collet means;

biasing means operably connected to said piston means for normally forcing said surface means upon said collet means;

attachment means operably connected to said biasing means to remove said surface means from said collet means to permit insertion of said tube; and passage defining means in said piston to force said surface means on said collet means upon passage of fluid in said axially centered passage.

2. The device of claim 1 which further includes sealing means for prevention of passage of fluid on the outer portions of said tube.

3. The device of claim 1 wherein said surface means further includes body means for enclosing said piston and said biasing means, said body means containing sealing means for prevention of passage of fluid through the interface between said surface means and said collet means.

4. The device of claim 1 wherein said attachment means includes pivot means operating against the force of said biasing means in an amount sufficient to remove pressure of said surface means on said collet means.

5. The device of claim 1 wherein said collet means are fixedly positioned with respect to said piston means, and said attachment means is adapted to slidably move said collet means through movement of said piston means in a direction away from said surface means to remove closing pressure on said collet means.

* * * * *